US005617634A

United States Patent [19]

Moesmann

[11] Patent Number: 5,617,634

[45] Date of Patent: Apr. 8, 1997

[54] SLICER FOR SLICING CHEESE AND THE LIKE ARTICLES OF FOOD

[76] Inventor: Søren Moesmann, 5, Sølstedgårdvej, DK-6240, Løgumkloster, Denmark

[21] Appl. No.: 441,841

[22] Filed: May 16, 1995

[30] Foreign Application Priority Data

May 18, 1994 [DK] Denmark ..... 0561/1994

[51] Int. Cl.[6] ..... B26B 27/00

[52] U.S. Cl. ..... 30/116; 30/310

[58] Field of Search ..... 30/115–117, 300, 30/310

[56] References Cited

U.S. PATENT DOCUMENTS 316,759 4/1885 Dexter ..... 30/116

FOREIGN PATENT DOCUMENTS 2393509 2/1979 France ..... 30/310
2660590 4/1990 France .
WO8706517 11/1987 WIPO .

*Primary Examiner*—Douglas D. Watts
*Attorney, Agent, or Firm*—Flehr, Hohbach, Test, Albritton & Herbert

[57] ABSTRACT

A slicer for slicing cheese and the like articles of food comprising a slicing string being connected to a finger grip at one end. Moreover, the slicer is provided with a shank having an insertion portion adapted to be inserted into the cheese and a gripping portion adapted to be gripped by the user. A second end of the string is connected to the insertion portion.

2 Claims, 2 Drawing Sheets

SLICER FOR SLICING CHEESE AND THE LIKE ARTICLES OF FOOD

BACKGROUND FOR THE INVENTION

1. Field of the Invention

The invention relates to a slicer for slicing cheese and the like articles of food, and comprising a slicing string being connected to a finger grip at one end.

2. Background Art

FR-A1-2.660.590 discloses a slicer of the above type intended to slice a pâté arranged in a box. The slicer comprises a ring adapted to be arranged on the box, and a slicing string being connected to the ring at one end and connected to a finger grip at the other end.

Moreover, WO87/06517 discloses a slicer intended for slicing cheese arranged in a cylindrical box. The slicer comprises a slicing string, one end thereof being connected to the free edge portion of the box and the other end thereof being provided with a finger grip.

SUMMARY OF THE INVENTION

The object of the invention is to provide a slicer of the type stated in the introduction by means of which cheese may be sliced regardless of the size and shape thereof and without being touched by the user's fingers.

In satisfaction of the above object, there is provided by the present invention a slicer being characterised in that it further comprises a shank provided with an insertion portion adapted to be inserted into the cheese, and a gripping portion, adapted to be gripped by the user, and that a second end of the string is connected to the insertion portion.

Consequently, it is possible to slice a cheese or the like articles of food in the following manner:

The gripping portion of shank is gripped with one hand and the insertion portion of the shank is inserted into the cheese, until the connection point of the string to the shank is below the surface of the cheese corresponding to the desired thickness of the slice. Subsequent thereto, the grip is gripped with the other hand and the string is axially guided into the cheese corresponding to the desired thickness of the slice. The string is then moved along the periphery of the cheese to cut a slice.

According to the invention, the insertion portion be provided with a pointed, free end, thereby facilitating the insertion into the cheese of the insertion portion of the shank.

Moreover, according to the invention, the insertion portion may be provided with a retainment means to prevent an unintended removal of the shank from the cheese. In this connection, the retainment means may advantageously be provided with a helical portion. This embodiment of the invention is considered particularly advantageously, as a secure retainment in the cheese of the insertion portion of the shank is obtained, and as the thickness of the slice is easily controlled, said thickness being determined by how far the connection point of the string to the shank is inserted into the cheese.

Furthermore, according to the invention, the gripping portion of the shank may comprise a transverse grip.

Moreover, according to the invention, the second end of string may be pivotal connected to the shank, thus avoiding that the string coils itself around the shank, when a slice is cut.

According to the invention, the connection between the shank and the string may, further, be formed by a loop at the end of the string, said loop being received in a circumferential groove on the shank.

Finally, according to the invention, the pivotal connection between the shank and string may be formed of a slotted sleeve formed at the second end of the string, said sleeve being in snap engagement with a portion of the shank of a reduced diameter.

BRIEF DESCRIPTION OF THE DRAWINGS

The invention is explained in detail below with reference to the drawings, in which.

DETAILED DESCRIPTION OF THE PREFERRED EMBODIMENTS

Figure 1:
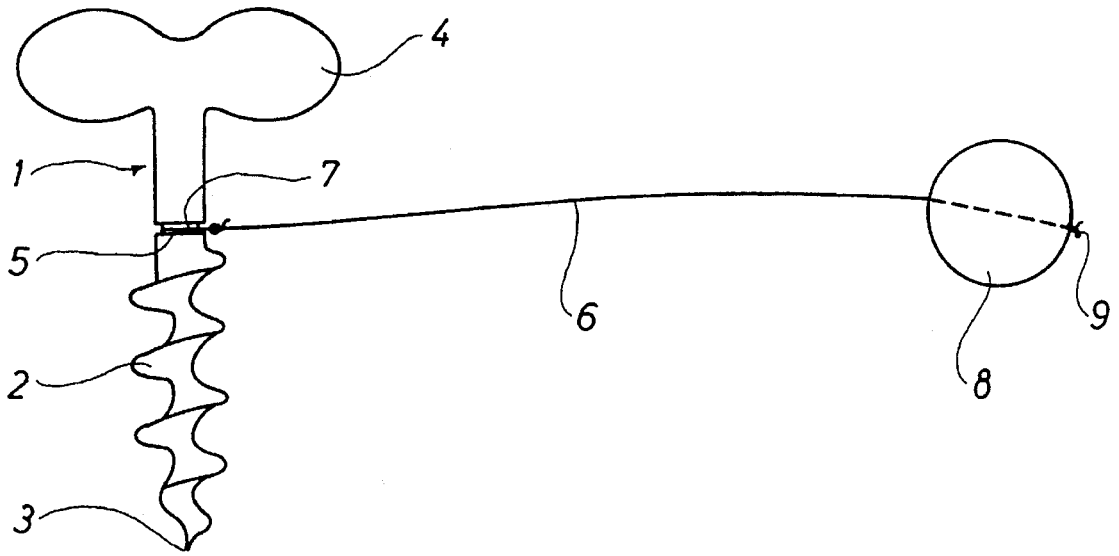
FIG. 1 illustrates a first embodiment of the slicer according to the invention.

The slicer shown in FIG. 1 comprises a shank 1 provided with a lower, helical insertion portion 2, ending in a tip 3, and a gripping portion 4 formed of a transverse grip 4. Immediately above the helical portion 2, the shank is provided with a circumferential groove.

At one end thereof, a flexible string 6 is provided with a loop 7 received in the groove 5. The loop 7 is formed by winding the thread about the shank and tying it to itself.

At a second end, the string 6 is connected to a disk-shaped finger grip 8. The string is connected to the grip by being passed through a transverse bore in the finger grip 8 and then tying a knot 9 thereon.

Figure 2:
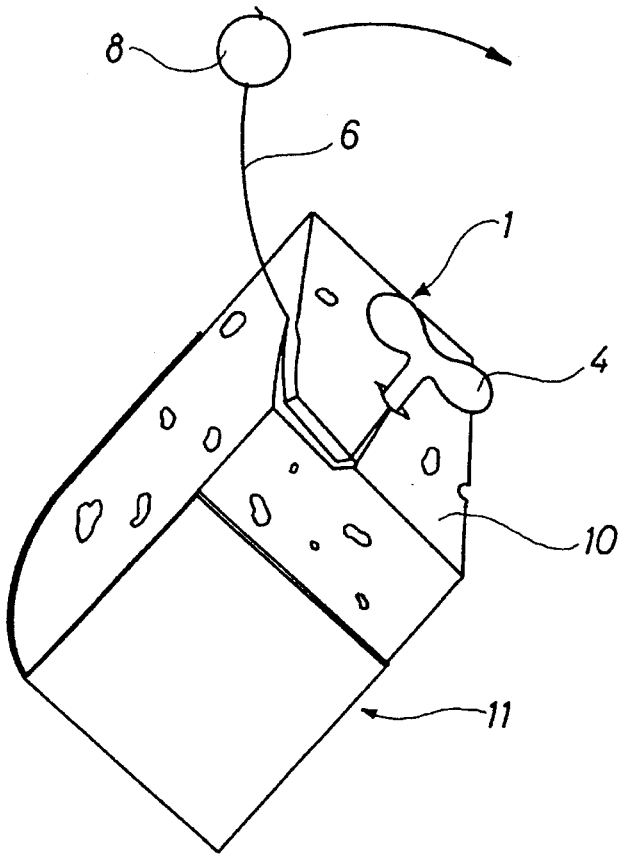
FIG. 2 illustrates the use of the slicer shown in FIG. 1.

As illustrated in FIG. 2, for slicing a cheese, the helical portion 2 of the shank 1 is screwed into the end face 10 of a cheese 11, until the groove 5 is below the end face 10 at a depth corresponding to the thickness of the desired slice. Then the finger grip 8 is gripped and the string 6 is tightened and guided slightly into the end face 10 corresponding to the desired thickness of the slice. For cutting a slice, the finger grip 8 is moved about the periphery of the cheese while the string is held tight. In order to cut a new slice, the helical portion 2 of the shank 1 is screwed into the cheese corresponding to the desired thickness of the slice, whereafter the above procedure is carried out for cutting the slice.

By means of the slicer according to the invention, a cheese may be sliced without being touched by the person's fingers, the transverse grip 4 being gripped with one hand and the finger grip 8 being gripped with the other hand. The slicer can remain in engagement with the cheese, until it has been used up and can, moreover, be packed with the cheese during storage thereof.

Figure 3:
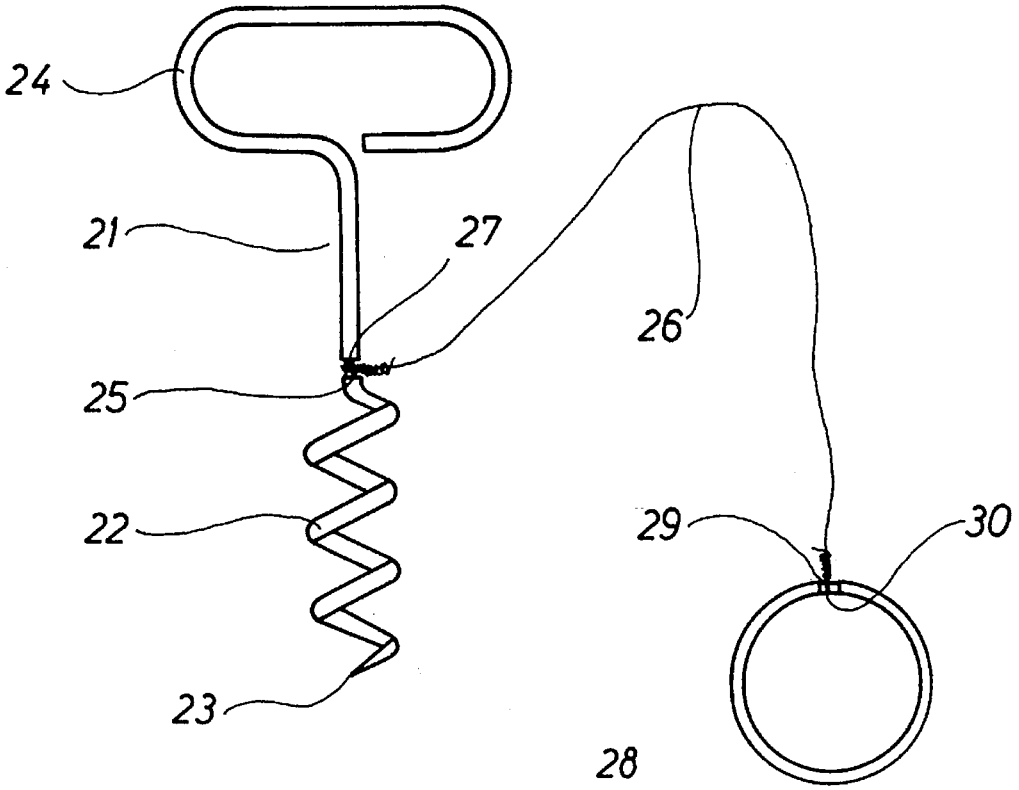
FIG. 3 illustrates an alternative embodiment of the slicer according to the invention.

The embodiment of the slicer according to the invention shown in FIG. 3 comprises a shank 21 made of a wire or thin rod. At one end, the wire is bent helically to form a helical engagement portion 22, ending in a tip 23. At a second end, the thready material is bent to form an eye 24, forming a grip. Between the eye 24 and the helical portion 22, the shank 21 is provided with a circumferential groove 25.

A loop 27 formed at one end of a flexible string 26 is received in the groove 25. Likewise, at a second end of the string 26, a loop 29 is formed. The loop 29 is received in a groove 30 on an annular finger grip 28.

The slicer shown in FIG. 3 is used in the same manner as described above with reference to the slicer shown in FIG. 1 and FIG. 2.

In both the above embodiments of the slicer, the shank, the string and the grip may be made of metal, for instance stainless steel, or plastics, for instance polyamide and other suitable materials.

Figure 4:
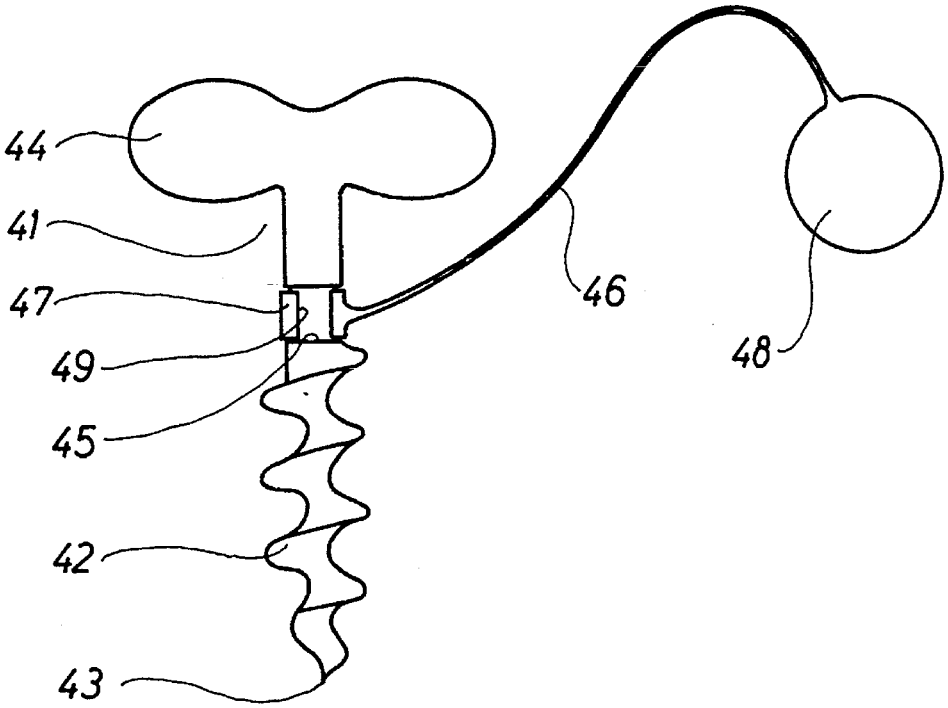
FIG. 4 illustrates yet another embodiment of the slicer according to the invention.

The embodiment of the slicer shown in FIG. 4 comprises a shank 41 provided with a lower, helical insertion portion 42, ending in a tip 43, and an upper, transverse grip 44. Between the insertions portion 42 and the grip 44, the shank is provided with a circumferential groove 45.

At one end, a flexible string 46 is provided with a slotted sleeve 47 having a slot 49 being displaced at an angle of 90° from the connection point of the string 46 to the sleeve 47. At a second end, the string is provided with a spherical finger grip 48. By means of snap action, the sleeve 47 is pivotally arranged in the groove 45 of the shank. In this respect, the width of the slot 49 is slightly smaller than the diameter of the shank in the portion at the groove 45. The slotted sleeve 47, the string 46 and the finger grip 48 may be integrally made of plastics, preferably polyamide. The shank 41 is preferably made of stainless steel or plastics.

I claim:

1. A slicer for slicing cheese and the like articles of food, and comprising a slicing string, being connected to a finger grip at a first end, wherein said slicer further comprises a shank provided with an insertion portion adapted to be inserted into the cheese, and a gripping portion adapted to be gripped by the user, and wherein a second end of the string is connected pivotally to the insertion portion of the shank, and wherein the pivotal connection between the shank and the string is formed of a slotted sleeve formed at a second end of the string, said sleeve being in snap engagement with a portion of the shank of a reduced diameter.

2. A slicer for slicing cheese and the like articles of food, and comprising a slicing string, being connected to a finger grip at a first end, wherein said slicer further comprises a shank provided with an insertion portion adapted to be inserted into the cheese and comprising a helical section and a gripping portion adapted to be gripped by the user, wherein a second end of the string is connected pivotally to the insertion portion, and wherein the pivotal connection between the shank and the string is formed of a slotted sleeve formed at a second end of the string, said sleeve being in snap engagement with a portion of the shank of a reduced diameter.

* * * * *